United States Patent [19]

Lembeck

[11] Patent Number: 4,815,268

[45] Date of Patent: Mar. 28, 1989

[54] FRICTION SPINNING APPARATUS

[75] Inventor: Theo Lembeck, Mönchen-gladbach, Fed. Rep. of Germany

[73] Assignee: W. Schlafhorst & Co., Mönchen-gladbach, Fed. Rep. of Germany

[21] Appl. No.: 106,580

[22] Filed: Oct. 8, 1987

[30] Foreign Application Priority Data

Oct. 11, 1986 [DE] Fed. Rep. of Germany ..... 3634792

[51] Int. Cl.[4] ..... D01H 7/892; D01H 7/898; D01H 1/135

[52] U.S. Cl. ..... 57/401; 57/408; 57/411

[58] Field of Search ..... 57/401, 408, 409, 411, 57/417

[56] References Cited

U.S. PATENT DOCUMENTS

| | | | |
|---|---|---|---|
| 4,522,023 | 6/1985 | Stahlecker | 57/401 |
| 4,537,022 | 8/1985 | Stahlecker | 57/401 |
| 4,571,932 | 2/1986 | Stahlecker et al. | 57/401 |
| 4,606,187 | 8/1986 | Stahlecker | 57/401 |
| 4,628,679 | 12/1986 | Stalder et al. | 57/401 |
| 4,640,090 | 2/1987 | Lembeck | 57/401 |
| 4,653,264 | 3/1987 | Stahlecker et al. | 57/401 |
| 4,759,176 | 7/1988 | Stahlecker | 57/401 |
| 4,760,693 | 8/1988 | Billner | 57/401 |

FOREIGN PATENT DOCUMENTS

| | | |
|---|---|---|
| 0339778 | 11/1977 | Austria . |
| 2732678 | 2/1979 | Fed. Rep. of Germany . |
| 2930998 | 5/1981 | Fed. Rep. of Germany . |
| 3205303 | 9/1982 | Fed. Rep. of Germany . |
| 3316656 | 11/1984 | Fed. Rep. of Germany . |
| 3321228 | 12/1984 | Fed. Rep. of Germany . |
| 3443667 | 6/1986 | Fed. Rep. of Germany . |
| 3502427 | 7/1986 | Fed. Rep. of Germany . |
| 3520636 | 12/1986 | Fed. Rep. of Germany . |
| 1574531 | 9/1980 | United Kingdom . |

*Primary Examiner*—John Petrakes

*Attorney, Agent, or Firm*—Herbert L. Lerner; Laurence A. Greenberg

[57] ABSTRACT

A friction spinning apparatus includes first and second perforated drums forming a spinning wedge therebetween with a spinning zone. The drums are driven in the same direction with the first drum having a greater circumferential speed than the second drum and with the first drum rotating into the spinning wedge and the second drum rotating out of the spinning wedge. The drums define an imaginary line at a location at which the drums are closest to each other. First and second suction devices are disposed in the interior of the first and second drums. The suction devices each have an intake slit formed therein. The intake slits follow paths diverging from each another and from the imaginary line at least at forward ends thereof. The intake slits are directed against the spinning wedge and each discharge in the vicinity of the inner surface of a respective one of the drums. Substantially greater suction action is supplied in the first suction device at a rearwardly directed end of the spinning zone than in the second suction device. A fiber supply device has a fiber guide channel with a slit-like fiber outlet opening formed therein and disposed in the spinning wedge, and a yarn draw-off device is provided.

12 Claims, 2 Drawing Sheets

FRICTION SPINNING APPARATUS

The invention relates to a friction spinning apparatus with two perforated drums being drivable in the same direction forming a spinning wedge or wedge-shaped gap having a spinning zone, each of the drums having a suction device in the interior thereof with an intake slit directed against the spinning wedge or gap and discharging near the inner surface of the drum, a fiber supply device having a fiber guide channel with a slit-like fiber outlet opening disposed in the spinning wedge or gap, and a yarn draw-off device.

One problem experienced with friction spinning is that because of uncertainties of which one may not always be aware and because of peripheral spinning constraints, the yarn produced often cannot compete with yarn produced by conventional spinning methods, with regard to structure, uniformity and/or strength.

It is accordingly an object of the invention to provide a friction spinning apparatus, which overcomes the hereinafore-mentioned disadvantages of the heretofore-known devices of this general type and which improves the spinning product.

With the foregoing and other objects in view there is provided, in accordance with the invention, a friction spinning apparatus, comprising first and second perforated drums having inner surfaces and forming a spinning wedge therebetween with a spinning zone having forwardly directed and rearwardly directed ends, means for driving the drums in the same direction with the first drum having a greater circumferential speed than the second drum and with the first drum rotating into the spinning wedge and the second drum rotating out of the spinning wedge, the drums defining an imaginary line at a location at which the drums are closest to each other, a first suction device disposed in the interior of the first drum, a second suction device disposed in the interior of the second drum, the suction devices each having an intake slit with forwardly directed and rearward directed ends formed therein, the intake slits following paths diverging from each another and from the imaginary line at least at the forward ends thereof, the intake slits being directed against the spinning wedge and each discharging in the vicinity of the inner surface of a respective one of the drums, means for supplying substantially greater suction action in the first suction device at the rearwardly directed end of the spinning zone than in the second suction device, a fiber supply device having a fiber guide channel with a slit-like fiber outlet opening formed therein and disposed in the spinning wedge, and a yarn draw-off device.

Since the product of spinning with the friction spinning apparatus according to the invention is improved especially in terms of the nature of the yarn, the peripheral constraints of the spinning operation which have not been paid any particular attention before, are clearly improved by the invention as well.

As mentioned above, the circumferential speed of the first drum rotating into the spinning wedge or gap is greater than the circumferential speed of the second drum rotating out of the spinning wedge or gap. The difference in the circumferential speed is advantageously on the order of magnitude of 1–2%. This has proved to be a favorable range for the difference in circumferential speeds of the drums when cotton is being spun.

The features of the invention described below influence the supply of air and fiber in such a way that the spinning product is improved even further.

The additional air nozzles are advantageously connected to a source of compressed air in which an overpressure above atmospheric pressure on the order of magnitude of 60 mm head of water or water column pressure prevails. This has also proved to be particularly favorable for spinning cotton.

In accordance with another feature of the invention, the intake slit formed in the first suction device has a front portion disposed closer to the imaginary line than the intake slit formed in the second suction device.

In accordance with a further feature of the invention, the intake slit formed in the first suction device has a rear portion disposed farther away from the imaginary line than the intake slit formed in the second suction device.

In accordance with an added feature of the invention, the intake slit formed in the first suction device has a relatively narrower rear portion and a relatively wider front portion.

In accordance with an additional feature of the invention, the perforated drums have outer surfaces, and the outer surface of at least one of the drums is divided into alternating zones having different coefficients of friction with respect to yarn forming in the spinning wedge.

In accordance with yet another feature of the invention, the perforated drums have outer surfaces, and the outer surface of the first drum has a lower coefficient of friction with respect to yarn forming in the spinning wedge than the outer surface of the second drum.

In accordance with yet a further feature of the invention, the fiber guide channel has an end facing away from the slit-like fiber outlet opening having a slit formed therein being open toward the surroundings.

In accordance with yet an added feature of the invention, the suction action supplying means supplies a greater negative pressure in the first suction device than in the second suction device. This has proved to be particularly advantageous if a negative pressure on the order of magnitude of 700 mm water column pressure with respect to atmospheric pressure prevails in the first drum rotating into the spinning wedge or gap, while a negative pressure on the order of magnitude of 650 mm water column pressure with respect to atmospheric pressure prevails in the suction device of the second drum rotating out of the spinning wedge or gap, with an average draw-off speed. The negative pressure advantageously rises and falls with a rising or falling draw-off speed.

In accordance with yet an additional feature of the invention, there is provided a lamination wrapped on and covering the first drum, at least at a rear portion of the spinning zone, the lamination having a lower edge disposed just above yarn forming in the spinning wedge. In this way, not only is the spinning product further improved, but better conditions for joining yarn ends, that is the laying in of a yarn end in the spinning wedge or gap, are provided.

In accordance with still another feature of the invention, the fiber guide channel has an inlet and a side facing away from the spinning wedge having first and second supplementary air nozzles formed therein, the first supplementary air nozzle being disposed at the inlet of the fiber guide channel, and the second supplementary air nozzle being disposed several centimeters downstream of the first supplementary air nozzle, as seen in fiber flow direction in the fiber guide channel.

In accordance with still a further feature of the invention, there is provided an air guide plate disposed below the second supplementary air nozzle of the fiber guide channel, the air guide plate extending from the second supplementary air nozzle approximately 2 cm parallel to the fiber flow direction and dividing the fiber flow from supplementary air in the second supplementary air nozzle.

In accordance with a concomitant feature of the invention, the intake slit formed in the first suction device extends over substantially all of the spinning zone, and the intake slit formed in the second suction device extends over a portion of the spinning zone located toward a draw-off side for yarn forming in the spinning wedge. This even further improves the overall spinning outcome.

Other features which are considered as characteristic for the invention are set forth in the appended claims.

Although the invention is illustrated and described herein as embodied in a friction spinning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
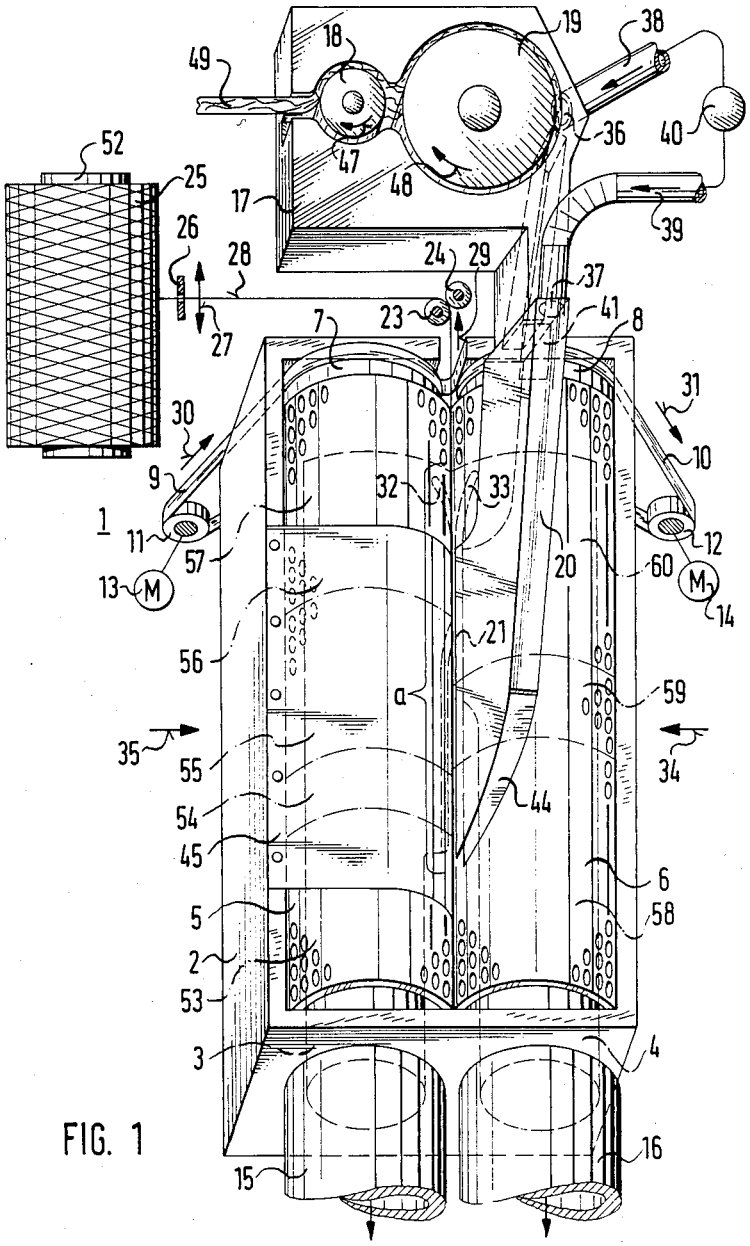
FIG. 1 is a fragmentary, partially perspective and partially schematic view of a friction spinning apparatus according to the invention.
Figure 3:
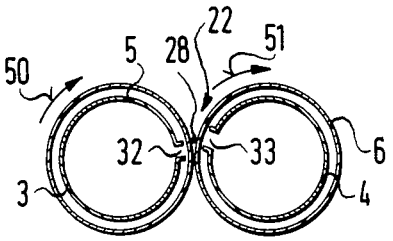
FIG. 3 is a cross-sectional view showing the configuration and location of suction devices.

Referring now to the figures of the drawings in detail and first, particularly, to FIG. 1 thereof, there is seen a friction spinning device 1 having a housing 2. The housing 2 has two tubular suction devices 3 and 4, on which perforated drums 5 and 6 are supported for easy movement by means of non-illustrated roller bearings. FIG. 3 shows that the drums 5, 6 are maintained at a specific distance from the suction devices 3, 4.

Pulleys 7, 8 disposed at the ends of the drums 5, 6 help the to drive the drums 5, 6 in the same direction.

A drive belt 9 is wrapped around the pulley 7 and another pulley 11 of a motor 13. A drive belt 10 is wrapped around the pulley 8 and another pulley 12 of a motor 14. The suction devices 3, 4 are connected to non-illustrated sources of vacuum or suction through ducts 15, 16.

A fiber supply device 17 which is shown in the opened position, is joined to the housing 2. The fiber supply device 17 includes a feed roller 18, an opening roller 19 and a fiber guide channel 20 adjoining the opening roller 19. As seen in FIG. 3, a slit-like fiber dispersion or outlet opening 21 of the fiber guide channel 20 is located in a spinning wedge or wedge-shaped gap 22 formed by the drums 5, 6. The spinning wedge or gap 22 has a spinning zone indicated by reference symbol "a".

A yarn draw-off device shown schematically in FIG. 1 is part of the friction spinning apparatus 1. The spinning zone "a" has forwardly directed and rearwardly directed ends with the forwardly directed end being adjacent the yarn draw-off side of the spinning zone. The yarn draw-off device is formed of a pair of rollers 23, 24, a cheese or cross-wound bobbin 25 driven to rotate and a yarn guide 26 that moves crosswise in the direction of a double arrow 27. A twisted yarn 28 forming in the spinning zone "a" is drawn off continuously in the direction of an arrow 29 by the pair of rollers 23, 24. The pair of rollers is in the form of one roller 23 that moves continuously and one guide roller 24 that can be pressed against the roller 23 and is drivable by friction.

During a spinning operation, the drive belt 9 travels in the direction of an arrow 30, so that the drum 5 rotates into the spinning wedge or gap, while the drive belt 10 travels in the direction of an arrow 31, so that the drum 6 rotates out of the spinning wedge or gap 22.

In FIG. 3, the yarn 28 that is caught in the spinning zone "a" is represented by a dot. The suction devices 3 and 4 have respective intake slits 32, 33. An imaginary line represents the location at which the drums 5, 6 are closest to each other. The suction device 3 is illustrated in a sectional plane located approximately 2 cm before the front end of the intake slits 32, 33. The front portion of the intake slit 32 of the suction device 3 is located nearer the imaginary line than the intake slit 33 of the suction device 4.

Figure 4:
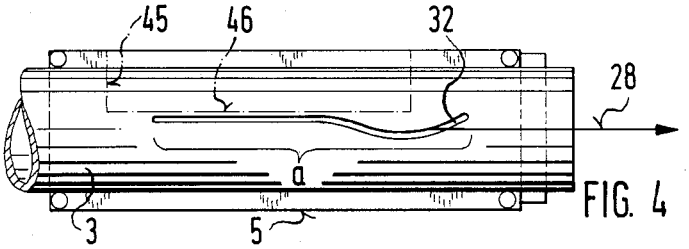
FIGS. 4 and 5 show the course and configuration of intake slits.
Figure 5:
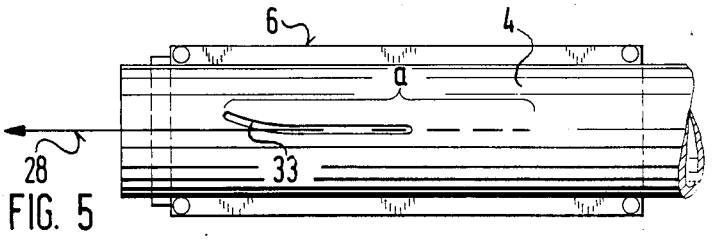

FIGS. 4 and 5 show that the intake slits 32 and 33 have a curved course or path and are disposed in a special manner. FIG. 4 shows a view of the suction device 3 as seen in the direction of an arrow 34 in FIG. 1. The intake slit 32 extends over substantially the entire spinning zone "a". The course of the intake slit 32 is curved and more specifically, the curvature has a shape or course that diverges from the course or path of the yarn 28 toward the yarn draw-off side. The rear portion of the intake slit 32 is markedly higher than the lowermost point of the front portion. The intake slit 32 is also wider at the front than at the back.

FIG. 5 is a view of the suction device 4 as seen in the direction of an arrow 35 in FIG. 1. Once again the intake slit 33 has a curved course or path. The intake slit 33 only extends over a portion of the spinning zone "a" and more specifically over a portion located toward the yarn draw-off side.

Figure 2:
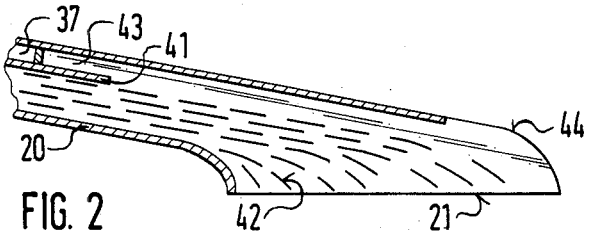
FIG. 2 is a fragmentary, longitudinal-sectional view taken through a front portion of a fiber guide channel.

The fiber guide channel 20 has two supplementary air nozzles 36 and 37 on the side thereof facing away from the spinning wedge or gap 22. The first supplementary air nozzle 36 is located at the entrance of the fiber guide channel 20, at the point where the fiber guide channel 20 adjoins the opening roller 19. The supplementary air nozzle 36 communicates with a source of compressed air 40 through a duct 38. The second supplementary nozzle 37 is located a few centimeters downstream from the first. As seen in FIG. 2, an air guide plate 41 which extends approximately 2 cm in the direction of the flow of fibers 42 from the second supplementary air nozzle 37 and divides the flow of fibers 42 from supplementary air 43, is located below the second supplementary air nozzle 37. A duct 39 joins the supplementary air nozzle 37 with the compressed air source 40.

The end of the fiber guide channel 20 on the side thereof facing away from the slit-like fiber dispersion opening 21, forms a slit 44 that is open toward the outside.

As shown in FIG. 1, the perforated drum 5 rotating into the spinning wedge or gap 22 is covered over almost the entire spinning zone "a" by a lamination or metal sheet 45 that is wrapped against the drum 5. As indicated in FIG. 4 with phantom lines, the lower edge 46 of the lamination or metal sheet 45 is located just above the yarn 28 that is being formed.

During a spinning operation, the feed roller 18 rotates more slowly in the direction of an arrow 47 than the opening roller 19 rotates in the direction of an arrow 48. Sliver 49 is grasped by the feed roller 18 and carried to the opening roller 19, which opens up the sliver 49 into individual fibers. Entraining air flows in the form of a flow of fibers 42 passing through the fiber guide channel 20 assure further entrainment of the individual fibers. The entraining air originates in the negative pressure that prevails in the suction devices 3 and 4. In particular, it is the somewhat greater negative pressure, on the order of magnitude of 700 mm of water column pressure, that prevails in the suction device 3 and which comes into effect in the fiber guide channel 20 as well, where it generates an entraining flow of air. In the suction device 4, a negative pressure on the order of magnitude of only 650 mm of water column pressure prevails, so that this suction device contributes less to the generation of the entraining air flow in the fiber guide channel 20, especially since the intake slit 33 of the suction device 4 is also smaller than the intake slit 32 of the suction device 3. Furthermore, the entraining air flow in the fiber guide channel 20 also originates in the air flowing out of the supplementary air nozzles 36 and 37, which originates in the compressed air source 40. An overpressure prevails in the compressed air source 40 which is on the order of magnitude of 60 mm of water column pressure above atmospheric pressure. The open slit 44 at the end of the fiber guide channel 20 assures an equalization of pressure with the atmosphere, which in turn affects the flow of fibers 42 that moves toward the intake slits 32 and 33, without causing any backup effects at the end of the fiber guide channel 20.

The motors 13 and 14, which are geared motors, are controllable so that the rotational speeds of the drums 5 and 6 can be adjusted. The direction of rotation is indicated in FIG. 3 by arrows 50 and 51. The circumferential speed of the drum 5 is somewhat greater than the circumferential speed of the drum 6, with the difference in circumferential speeds being approximately 1.5%. This is the case, for example, if the drum 5 rotates at 3,146 rpm, and the drum 6 rotates at only 3,100 rpm.

If the yarn or thread 28 should run out or break, the yarn ends must be rejoined. To this end, a piece of yarn or thread connected to the cheese or cross-wound bobbin 25 or to the sleeve or tube 52 thereof, is laid into the spinning wedge or gap 22 on the right-hand side of the fiber guide channel 20, with the drums 5 and 6 at a stop but with the suction devices 3 and 4 in operation. At this location, the piece of yarn or thread automatically enters the spinning zone "a" because of the suction exerted by the intake slits 32 and 33. With the onset of drum rotation, the fiber supply can then begin as well, and yarn can begin to be drawn off.

The outer surfaces of the perforated drums 5 and 6 are divided into alternating zones having different coefficients of friction with respect to the yarn 28, according to which they are paired in terms of friction. FIG. 1 shows that in the yarn draw-off direction, the surface of the drum 5 is divided into zones 53–57, while the surface of the drum 6 is divided into zones 58–60. The zones 54, 56 and 59 have a higher coefficient of friction with respect to the other frictional member, which is the yarn 28, than do the other zones.

The zones of one drum that have a "better grip" each face the zones of the other drum having a poorer grip. Conversely, according to an alternative embodiment, the zones having an increased coefficient of friction with respect to the other frictional member, the yarn, face one another. Additionally, or alternatively, according to another embodiment, the outer surface of the drum rotating into the spinning wedge or gap may have a lower coefficient of friction with respect to the other frictional member, the yarn, than the outer surface of the drum rotating out of the spinning wedge or gap. This feature may also be advantageous for certain applications.

I claim:

1. Friction spinning apparatus, comprising first and second perforated drums having inner surfaces and forming a spinning wedge therebetween with a spinning zone having forwardly directed and rearwardly directed ends with the forwardly directed end being adjacent a yarn draw-off side of said spinning zone, means for driving said drums in the same direction with said first drum having a greater circumferential speed than said second drum and with said first drum rotating into said spinning wedge and said second drum rotating out of said spinning wedge, said drums defining an imaginary line at a location at which said drums are closest to each other, a first suction device disposed in the interior of said first drum, a second suction device disposed in the interior of said second drum, said suction devices each having an intake slit with forwardly directed and rearward directed ends formed therein, said intake slits following paths diverging from each other and from said imaginary line at least at said forward ends thereof, said intake slits being directed against said spinning wedge and each discharging in the vicinity of said inner surface of a respective one of said drums, means for supplying substantially greater suction action in said first suction device at said rearwardly directed end of said spinning zone than in said second suction device, a fiber supply device having a fiber guide channel with a slit-like fiber outlet opening formed therein and disposed in said spinning wedge, and a yarn draw-off device.

2. Friction spinning apparatus according to claim 1, wherein said intake slit formed in said first suction device has a front portion disposed closer to said imaginary line than said intake slit formed in said second suction device.

3. Friction spinning apparatus according to claim 1, wherein said intake slit formed in said first suction device has a rear portion disposed farther away from said imaginary line than said intake slit formed in said second suction device.

4. Friction spinning apparatus according to claim 1, wherein said intake slit formed in said first suction device has a relatively narrower rear portion and a relatively wider front portion.

5. Friction spinning apparatus according to claim 1, wherein said perforated drums have outer surfaces, and said outer surface of at least one of said drums is divided into alternating zones having different coefficients of friction with respect to yarn forming in said spinning wedge.

6. Friction spinning apparatus according to claim 1 wherein said perforated drums have outer surfaces, and said outer surface of said first drum has a lower coefficient of friction with respect to yarn forming in said spinning wedge than said outer surface of said second drum.

7. Friction spinning apparatus according claim 1, wherein said fiber guide channel has an inlet and a side facing away from said spinning wedge having first and second supplementary air nozzles formed therein, said first supplementary air nozzle being disposed at said inlet of said fiber guide channel, and said second supplementary air nozzle being disposed several centimeters downstream of said first supplementary air nozzle, as seen in fiber flow direction in said fiber guide channel.

8. Friction spinning apparatus according to claim 7, including an air guide plate disposed below said second supplementary air nozzle of said fiber guide channel, said air guide plate extending from said second supplementary air nozzle approximately 2 cm parallel to said fiber flow direction and dividing said fiber flow from supplementary air in said second supplementary air nozzle.

9. Friction spinning apparatus according to claim 1, wherein said fiber guide channel has an end facing away from said slit-like fiber outlet opening having a slit formed therein being open toward the surroundings.

10. Friction spinning apparatus according to claim 1, wherein said suction action supplying means supplies a greater negative pressure in said first suction device than in said second suction device.

11. Friction spinning apparatus according to claim 1, including a lamination wrapped on and covering said first drum, at least at a rear portion of said spinning zone, said lamination having a lower edge disposed just above yarn forming in said spinning wedge.

12. Friction spinning apparatus according to claim 1, wherein said intake slit formed in said first suction device extends over substantially all of said spinning zone, and said intake slit formed in said second suction device extends over a portion of said spinning zone located toward a draw-off side for yarn forming in said spinning wedge.

* * * * *